E369Z OR 4,336,460

United States Patent [19]
Best et al.
[11] 4,336,460
[45] Jun. 22, 1982

[54] SPENT FUEL CASK

[75] Inventors: Ralph E. Best, Dublin, Ohio; Vijay Bhandari, Chamblee, Ga.; Richard L. Creeden, Poway, Calif.; Michael E. Mason, Lilburn, Ga.; Harrison R. Panter, Norcross, Ga.; Jack D. Rollins, Roswell, Ga.; Richard A. Schreiber, Decatur, Ga.

[73] Assignee: Nuclear Assurance Corp., Atlanta, Ga.

[21] Appl. No.: 60,794

[22] Filed: Jul. 25, 1979

[51] Int. Cl.[3] ..... G21F 5/00
[52] U.S. Cl. ..... 250/506
[58] Field of Search ..... 250/506, 507; 176/30; 248/130, 137

[56] References Cited

U.S. PATENT DOCUMENTS 2,324,747 7/1943 Weissert ..... 248/137
3,886,368 5/1975 Rollins et al. ..... 250/507
3,962,587 6/1976 Dufrane et al. ..... 250/506

*Primary Examiner*—Bruce C. Anderson
*Attorney, Agent, or Firm*—Jones, Thomas & Askew

[57] ABSTRACT

A cask for containing spent nuclear fuel during transport. The cask has a pair of multiple element trunnions disposed on opposite sides of the cask adjacent the top thereof. The multiple elements of the trunnions provide separate and independent load paths for lifting the cask. The trunnions are removable and disassemblable to permit inspection of each element. Disposed on the ends of the cask are convex impact limiters for reducing forces applied to the cask in a collision. Apparatus engageable with the trunnions for lifting the cask thereby comprise a pair of multiple element laminated plates engageable with a crane hook. A pair of multiple element straps have ends selectively engageable with the plates and ends selectively engageable with the trunnions of the cask.

8 Claims, 6 Drawing Figures

SPENT FUEL CASK

DESCRIPTOIN

TECHNICAL FIELD

The present invention relates generally to shipping containers, and more particularly relates to shipping containers used to contain spent nuclear fuel assemblies during transport.

BACKGROUND

In the operation of a nuclear reactor, the fissionable nuclear fuel is typically contained in a fuel rod bundle or assembly. The fuel in the reactor is useful for a period of time and then becomes depleted and is no longer useful for a fission reaction in its present form. The nuclear fuel may, however, be reprocessed by techniques known in the art to yield fissionable material once again. Since reprocessing facilities are few and far between, spent nuclear fuel assemblies must often be transported for great distances.

Although the spent nuclear fuel is no longer useful in fission reactions, it is nevertheless still "hot" in terms of both radioactivity and temperature. In order to render the fuel assembly safe for handling outside the reactor vessel, the fuel assembly is usually loaded into a shipping cask. U.S. Pat. No. 3,962,587 (incorporated herein by reference) discloses such a shipping cask.

The shipping casks generally comprise a body for containing the spent nuclear fuel assembly therein. The body of the cask is typically made of a heavy shielding material to absorb radiation from the material inside. The shipping cask is usually loaded by lowering into a storage pool at the nuclear power plant. When the cask is removed from the pool, it contains both the fuel assembly and water from the pool, which may or may not be drained off later. The loaded cask is extremely heavy and since it contains highly radioactive material, measures must be taken to insure that the cask is not dropped. In order to provide the desired extra measure of safety required, the trunnions attached to the cask for lifting the cask are usually oversized to withstand several times the normal load levels. Inspection is usually required against material failure and/or attachment failure, such as a defect in a weld. Thorough inspection is often difficult or impossible, and is always a costly expedient.

Another expedient is to provide a redundant number of trunnions, along with a hoisting yoke which attaches to all trunnions and which transfers the load to the remaining trunnions if one trunnion should fail. That expedient is also expensive, and the added presence of the yoke impedes the loading and unloading of spent fuel assemblies.

The shipping cask is typically transported by railroad car or by truck. Since the possibility of a crash is always present, precautions must be taken to minimize the probability of a cask rupture upon impact with an obstacle. Impact limiters have been used in the past to minimize this probability. An impact limiter generally comprises a cap-like structure filled with a crushable material which fits on the ends of the cask. Upon impact the crushable material absorbs a large portion of the impact energy, thereby reducing the forces applied to the body of the cask. Controlled absorption of the impact is a desirable feature of such impact limiters.

SUMMARY OF THE INVENTION

The present invention relates to a shipping cask for spent nuclear fuel, the cask having multiple element trunnions attachable thereto to provide load path redundency in case of a material failure and to provide for ease of inspection. The present invention also includes a multiple element lifting yoke compatible with the trunnions on the cask and impact limiters for the ends of the cask.

The shipping cask generally comprises an elongate body for containing spent nuclear fuel assemblies. A pair of trunnions are detachably disposed on the outer surface of the body adjacent the top end thereof. The trunnions each comprise a first element attached to the body to provide a first load path and a second element attached to the body to provide a second load path.

The lifting yoke generally comprises a pair of lifting plates assemblable about a conventional crane hook and a pair of side arms attachable to the lifting plates. The lower end of each side arm is engagable with the trunnions of the shipping cask. Both the lifting plates and the side arms are comprised of a plurality of elements detachably laminated to one another.

The impact limiters generally comprise a cap-like structure filled with a crushable substance and engagable with the ends of the cask. The impact limiters have an impact surface which is convex to thereby distribute impact forces gradually over the impact surface.

Accordingly, it is an object of the present invention to provide am improved cask for transporting spent nuclear fuel.

It is another object of the present invention to provide an improved lifting apparatus for lifting spent nuclear fuel casks.

A further object of the present invention is to provide improved impact limiters for spent nuclear fuel casks.

Yet another object of the present invention is to provide a spent nuclear fuel cask having lifting trunnions which provide separate and distinct load paths between the trunnions and the cask.

Another object of the present invention is to provide multiple element trunnions which are removable from a spent nuclear fuel cask to provide easy inspection for defects.

Still another object of the present invention is to provide lifting apparatus which is multiply redundant and disassemblable for easy inspection.

These and other objects, features and advantages of the present invention will become apparent after a review of the following detailed description of the disclosed embodiment and the appended drawing and claims.

DETAILED DESCRIPTION OF THE DISCLOSED EMBODIMENT

Figure 2:
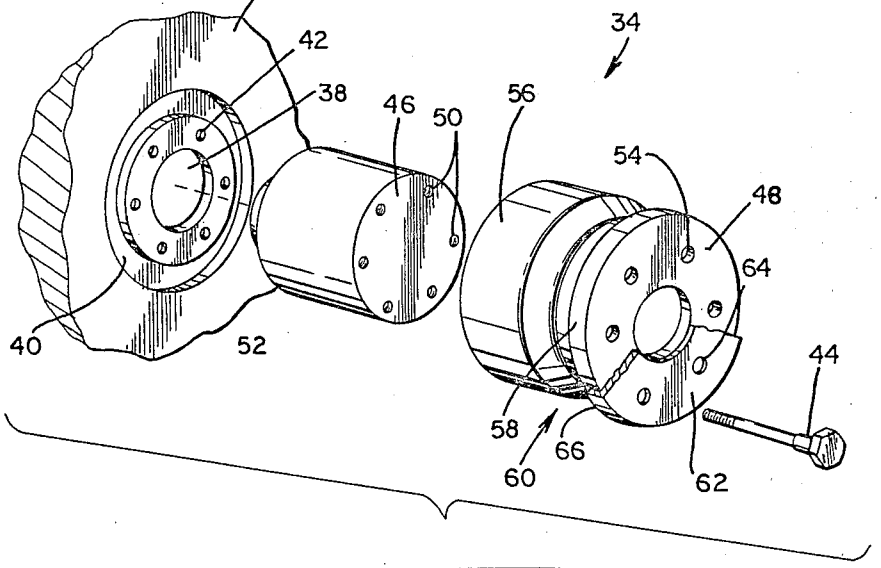
FIG. 2 is a detailed exploded view of one of the trunnions shown in FIG. 1.

Referring now to the drawing in which like numbers indicate like elements throughout the several views, it will be seen that there is a cask 10 of a generally cylindrical shape suspended from a lifting yoke 12. The cask 10 generally comprises a hollow thick-walled cylindrical metal body 14 having a top end 16 and bottom end 18, a removable closure lid 20 removably attached to the top end of a non-removable closure 22 permanently fixed in the bottom end, thereby defining a generally cylindrical chamber 24 (FIG. 5) for accepting conventional nuclear fuel assemblies. The size and shape of the cask 10 may be varied to accommodate differently designed fuel assemblies, typical of which are PWR, BWP, Biblis/Westinghouse XL and the like.

The cask 10 is provided with pressure relief valves (not shown) for relieving pressure which may build up in the chamber 24 due to heat generated by spent nuclear fuel contained therein. The cask 10 is also provided with drain valves (not shown) for draining liquid from the chamber 24. The cask 10 may therefore be of the wet cavity or the dry cavity type. Both pressure relief valves and drain valves are well known in the art and their design for use in combination with the cask 10 is within the skill of the art.

The removable lid 20 is attached to the top end 16 of the body 14 by a plurality of bolts 26. The lid 20 fits inside a flange 28 to provide a tight seal to the chamber 24. Additional techniques for assuring a tight seal, such as providing one or more elastomeric O-rings interposed between the body 14 and the lid 20, may also be used. The non-removable closure 22 is secured in the bottom end 18 of the body 14 by suitable means, such as by welding, so that the chamber 24 is sealed both ends when the lid 20 is in place.

Disposed about the central portion of the body 14 is a neutron shield 30 to provide additional neutron attenuation. The neutron shield 30 may comprise a 1.96 inch thick layer of water-extended polyester (WEP) encapsulated in a channel, or a borated water-ethylene glycol solution contained in a 1.8 inch thick annular tank. The WEP material is a solid matrix of hardened polyester plastic and encapsulated water-boron-ethylene glycol liquid droplets. The water-extended polyester is retained and hermetically sealed by an epoxy potting compound.

Disposed adjacent the top end 16 of the body 14 is a tie down plate 32 used for securing the cask 10 to a transport vehicle as will be described in more detail hereinbelow.

Disposed on opposite sides of the body 14 adjacent the top end 16 of the cask 10 are a pair of multiple element trunnions 34, 36. Each trunnion 34, 36 is comprised of a plurality of elements to provide dual load path redundancy to the trunnions which bear the full weight of the cask 10 when it is lifted. In this manner, should one element fail, that portion of the weight of the cask 10 supported by that trunnion will be supported completely by the remaining element of that trunnion. Optionally, a pair of multiple element trunnions 37*a*. 37*b* may also be disposed on opposite sides of the body 14 adjacent the bottom end 18 of the cask 10.

Figure 3:
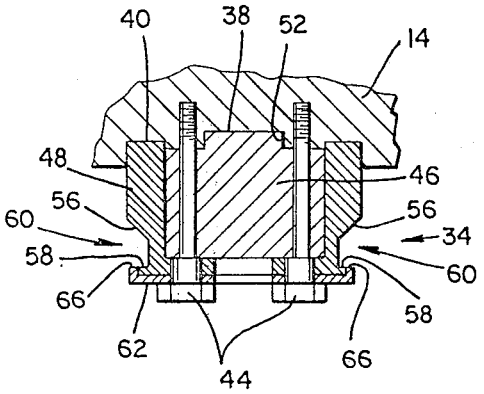
FIG. 3 is a cross-sectional view of the assembled trunnion shown in FIG. 2.

Formed in the surface of the body 14 of the cask 10 is a cylindrical groove 38 and an annular groove 40, as best seen in FIG. 2 and 3. Interposed between the cylindrical groove 38 and the annular groove 40 are a plurality of threaded holes 42 for receiving the threaded ends of bolts 44 which secure the trunnions 34, 36 to the body 14. Each trunnion 34, 36 includes an inner trunnion element 46 and an outer trunnion element 48. The inner element 46 is composed of a solid piece of material having a plurality of holes 50 therein to pass the bolts 44 therethrough. The inner element 46 also includes a boss 52 of the same size and shape as the cylindrical groove 40 so as to be received in the cylindrical groove when the trunnions 34, 36 are bolted to the body 14.

The outer element 48 is hollow and fits over the inner trunnion 46 and is received in the annular groove 42 when bolted in place. The outer trunnion 48 also has a plurality of holes 54 therein for passing the bolts 44 therethrough. Two flanges 56, 58 define a channel or groove 60 in the outer element 48. The groove 60 is designed to receive the lifting yoke 12 and thereby prevent it from accidentally slipping off the trunnions. A cover plate 62 (shown partially broken away in FIG. 2) having a plurality of holes 64 therein for passing the bolts 44 therethrough is provided on the outer element 48. The cover plate 62 also includes a flange 66 which extends beyond the flange 58 of the outer trunnion 48 to thereby deepen the groove 60 and provide an additional redundancy to the trunnions 34, 36. That is, if the flange 58 were to fail, the flange 66 would retain the lifting yoke on the trunnions 34, 36.

In order to attach the trunnions 34, 36 to the body 14, the inner trunnion 46, the outer element 48 and the cover plate 62 are positioned so that the holes 50, 54, 64 are arranged in axial alignment and the bolts 44 are inserted therein and tightened. The cask 10 may then be lifted by the trunnions 34, 36 using the lifting yoke 12. It will be appreciated by those skilled in the art that the weight of the cask 10, when suspended by the trunnions 34, 36, is applied to both the inner element 46 and the outer element 48 of each trunnion. It will also be appreciated that the boss 52 of the inner element 46, when received in the cylindrical groove 38, and the outer element 48 when received in the annular groove 40, form separate shear registers. The weight supported by each of the trunnions 34, 36 is therefore applied via two separate and independent paths. Should either the inner element 46 or the outer element 48 of either trunnion fail, the other element is sufficient to support that portion of the weight of the cask 10 supported by that trunnion.

It is specifically contemplated that means other than the bolts 44 may be used to detachably attach the inner element 46 and the outer element 48 to the body 14. For example, the annular groove 40 and the annular outer element 48 may be provided with mating threads so that the outer element may be screwed into and out of engagement with the annular groove. Other means of attachment within the skill of the art may also be used.

In order to remove the trunnions 34, 36 to permit inspection of the inner element 46 and the outer element 48, the bolts 44 need merely be removed. The inner element 46 and the outer element 48 may then be removed and tested for defects by methods known in the art, such as by x-ray, magnafluxing or the like. If a defect is found, the defective element can be replaced and the trunnions 34, 36 bolted back in position.

Figure 1:
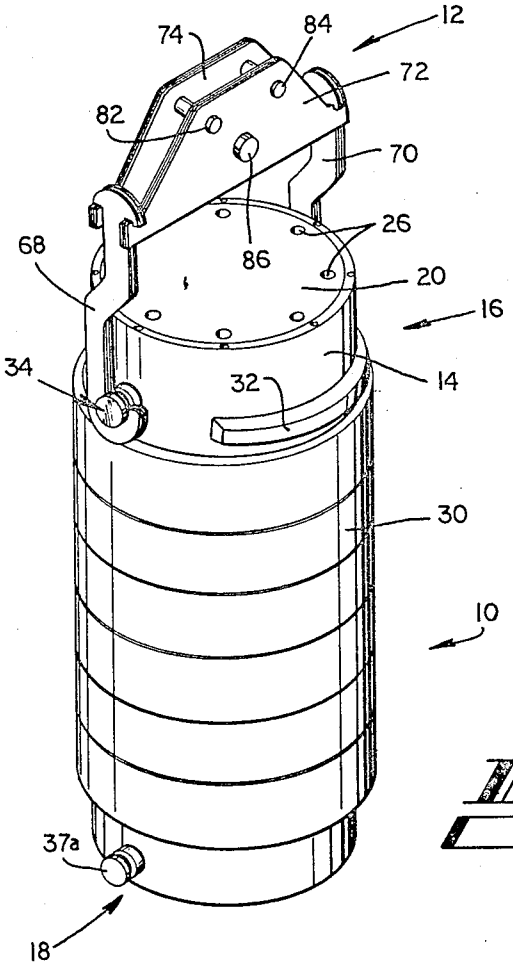
FIG. 1 is a pictorial view of a disclosed embodiment of the cask and lifting yoke according to the present invention.
Figure 6:
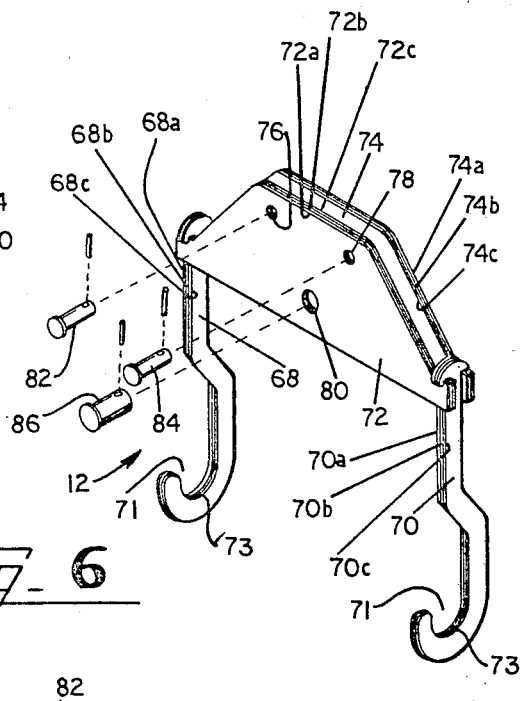
FIG. 6 is a detailed pictorial view of the lifting yoke shown in FIG. 1.

Referring now more particularly to FIGS. 1 and 6, it will be seen that the lifting yoke 12 generally includes a pair of side arms 68, 70 and a head piece comprising two trapazoidal lifting plates 72, 74 engagable with the side arms and a conventional crane hook (not shown). Each plate 72, 74 also has three holes 76–80 for receiving locking pins 82–86 therethrough.

Both the side arms 68, 70 and the lifting plates 72, 74 comprise a plurality of plate elements laminated to provide a single piece. For example, the side arm 68 is comprised of three plates 68*a*, 68*b*, 68*c* fastened together with bolts (not shown). The materials used for the plates 68*a*–68*c* are selected so that any two of the plates will support one and one-half the anticipated load placed on the side arm 68 during lifting of the cask 10. In this manner, should any one of the three plates 68*a*–68*c* fail, the other two plates are still capable of lifting and holding the cask 10 without breaking. Furthermore, the side arm 68 may be disassembled by removing the bolts holding the plates 68*a*–68*c* together, thereby permitting individual inspection of the plates using known techniques, such as x-ray, magnafluxing and the like. If one of the plates 68*a*–68*c* is found defective, it may be replaced with an identical plate and bolted back together to form a new side arm unit.

The other elements of the lifting yoke 12 are similarly constructed. The side arm 70 includes three plates 70*a*, 70*b*, 70*c*; the lifting plate 72 includes three plates 72*a*, 72*b*, 72*c*; and the lifting plate 74 includes three plates 74*a*, 74*b*, 74*c*. Each element can support one and one half its anticipated load with only two plates; and each element can be disassembled, inspected, replaced, if necessary, and reassembled.

In addition to each element of the lifting yoke 12 being disassemblable, the lifting yoke may be disassembled, that is, the side arms 68, 70 are separable from the lifting plates 72, 74. The ends of the lifting plates 72, 74 and the side arms 68, 70 fit together with mating slots so that the side arms are hung from the lifting plates rather than being welded thereto. This not only permits disassembly of the lifting yoke 12, but also dispenses with the need to inspect the integrity of welds.

The end 88 of each of the side arms 68, 70 is open hook or J-shaped, with the radius of the opening being slightly greater at the mouth 71 of the opening than at the crotch 73. The ends 88 of the side arms 68, 70 are designed to engage the groove 60 in the trunnions 34, 36 attached to the cask 10 in the manner best shown in FIG. 1. It will be appreciated by those skilled in the art that the flange 56 of the outer element 48 and the narrowing of the opening at the crotch 73 of the side arms 68, 70 guides the side arms into engagement with the groove 60 and that the flanges 58, 66 prevent the side arms from sliding out of the groove. Thus, the lifting yoke 12 provides a redundant means for lifting the cask 10 by the trunnions 34, 36.

Figure 4:
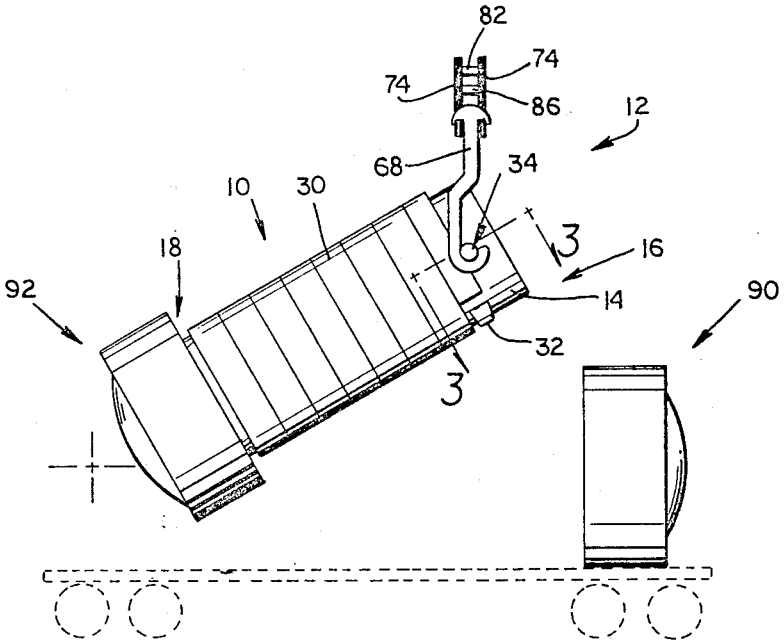
FIG. 4 is a pictorial view of the cask shown in FIG. 1 and a disclosed embodiment of the impact limiters of the present invention, one impact limiter being attached to one end of the cask and the other impact limiter awaiting mating with the other end of the cask.
Figure 5:
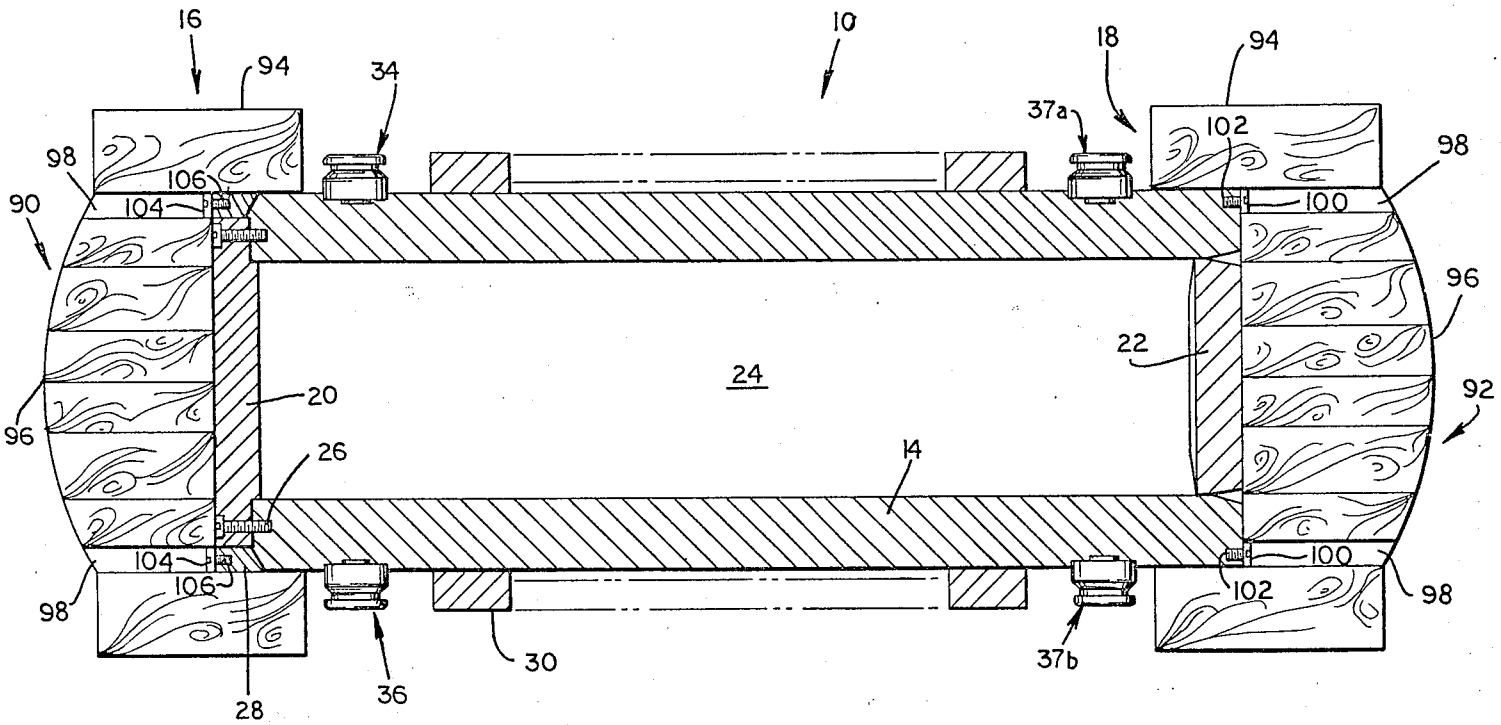
FIG. 5 is a cross-sectional view taken along the line 5—5 of the cask and impact limiters shown in FIG. 4, showing both impact limiters attached to the cask.

During transport of the cask 10, for example, from a reactor site to a reprocessing plant, it is essential to protect the cask against damage from a crash or impact. The present invention therefore provides a pair of removable impact limiters 90, 92 for engagement with the ends 16, 18 of the body 14 of the cask 10 (FIGS. 4 and 5). Both impact limiters 90, 92 are essentially the same in design and comprise an annular collar 94 encircling a central domed section 96 having a convex impact surface. The domed sections 96 of the impact limiters 16, 18 are of essentially the same diameter as the outside diameter of the body 14 of the cask 10 and generally fit flush against the closure 22 and the lid 20 respectively. The inside diameter of the annular collar 94 is only slightly greater than the outside diameter of the body 14 so that the annular collar can slip over the ends 16, 18 of the body. The domed section 96 is attached to the annular collar 94 such that when the domed section is seated against the lid 20 or the closure 22, a portion of the annular collar extends over the body 14.

Both the annular collar 94 and the domed section 96 are essentially hollow metal shells filled with a crushable substance, such as balsa wood or California redwood. Holes 98 are provided through the domed section 96 so that bolts 100 can be inserted therethrough. The bolts 100 engage threaded holes 102 in the edge of the body 14 in the bottom end 18 to thereby secure the impact limiter 92 thereto. Bolts 104 also engage threaded holes 106 in the flange 28 at the top end 16 of the body 14 to thereby secure the impact limiter 90 thereto.

It will be appreciated that in a head-on collision the domed sections 96, 98 would come into contact with a flat obstruction before the annular collars 94. Furthermore, as the domed sections 96, 98 collide with a flat obstruction, only the central portion of the domed section would initially contact the obstruction, with a progressively larger area coming in contact as the central portion collapsed and the collision continued. In this manner, the force of a collision is spread out over a longer period of time than would occur if the impact limiter were flat. The forces exerted on the cask 10 in a collision are therefore reduced over those experienced by the cask having a flat impact limiter.

The overall operation of the disclosed cask is now considered. When a nuclear fuel assembly at a nuclear power plant is exhausted for fissionable reaction purposes, the fuel assembly must usually be removed from the reactor vessel so that a new fuel assembly may be substituted therefor and the old fuel assembly transported to a reprocessing plant for recycling or to a storage facility for long term storage of the spent nuclear fuel. In order to perform this operation, an empty cask 10 is transport to the reactor site. It will be assumed that the nuclear reactor plant is equipped with a conventional crane and crane hook used at most nuclear reactors for the purpose of removing fuel assemblies from the reactor vessel. The lifting yoke 12 is assembled for lifting the cask 10 by placing the lifting plates 72, 74 on opposite sides of the crane hook. The pins 82–86 are then inserted through the holes 76–80, thereby securing the lifting plates 72, 74 in place. The side arms 68, 70 are then suspended from the ends of the lifting plates 72, 74 by engaging the slots in the upper end of the side arms and the ends of the lifting plates. The lifting yoke 12 is then ready to lift the cask 10.

It will be assumed that the cask 10 is in the configuration shown in FIG. 1 with the impact limiters 16, 18 not attached to the body 14 and the trunnions 34, 36 attached to the body, although it is intended that the trunnions be removed during transport. The bolts 26 securing the lid 20 are removed, and the hook ends 88 of the side arms 68, 78 are then engaged with the grooves 60 in the trunnions, 34, 36 by lowering the lifting yoke into the appropriate position. The cask 10 is then lifted and lowered into the spend fuel pool containing the spent nuclear fuel assembly. The lifting yoke 12 is then disengaged from the trunnions 34, 36; the lid 20 is removed; the spent fuel assembly is loaded into the chamber 24; the lid 20 is replaced; and the cask is removed from the pool by lifting the cask by the trunnions with the lifting yoke.

After the cask 10 has been loaded and removed from the spent fuel pool, the cask is then moved by crane to a waiting transportation vehicle, such as a flat bed railroad car 108 (shown in dotted lines in FIG. 4). The impact limiters 90 and 92 are slidably attached to the car 108 and are intended to remain with the car at all times, except during a collision.

The cask 10 is then lowered onto the railroad car 108 so that the bottom impact limiter 16 nests in a pivotable receptacle (not shown). The lifting yoke 12 then continues to lower the cask 10 as the crane traverses forwardly, thereby causing the cask to tip over to a horizontal position. The cask 10 is lowered in such a manner that the tie-down plate 32 is on the bottom side of the body 14. When the cask 10 is in a horizontal position, the lifting yoke 12 is then disengaged from the trunnions 34, 36. The lifting yoke 12 is disengaged from the crane hook by removing the pins 82–86 and removing the side arms 68, 70 from engagement with the ends of the lifting plates 72, 74. The side arms 68, 70, lifting plates 72, 74 and pins 82–86 are then stowed on the railroad car 108 for transport with the cask 10.

The cask 10 is secured to the railroad car 108 by inserting bolts (not shown) through a bracket (not shown) into the tie down plate 32. The bolts attaching the cask 10 to the railroad car 108 are of a size and type such that, in a collision, the bolts will shear off, thereby detaching the cask 10 and impact limiters 16, 18 from attachment to the railroad car.

Before transport of the cask 10, the trunnions 34, 36 may be removed from the body 14, by removing the bolts 44. The inner element 46, the outer element 48, the cover plate 62 and the bolts 44 are then stowed on the railroad car 108 for transport with the cask. After the trunions are moved, the impact limiters are positioned at the ends of the cask 10. The impact limiters are attached to the top end 16 and bottom end 18 of the cask 10 by inserting bolts 104 and 100, respectively. When the cask 10 reaches its destination, the trunnions 34, 36 are reattached to the body 14 for removal of the cask 10 from the railroad car 108.

In the event that the railroad car 108 collides with an obstacle during transport of the cask 10, the cask with the impact limiters 16, 18 attached thereto, may break away from the railroad car, depending on the severity of the collision. Any subsequent collisions of the cask 10 with obstacles are then softened by the impact limiters 16, 18 which are crushable, thereby reducing the possibility of rupture of the cask 10 and release of radioactive substances.

To remove the cask 10 from the railroad car 108, the trunnions 34, 36 are reattached to the body 14 of the cask, the tie down bolts are removed from the tie down plate 32, the impact limiter 16 is removed from the top end 16 of the cask by removing the bolts 104 and sliding the top impact limiter away from the cask. The lifting yoke 12 which has been reassembled on a suitable crane hook then engages the trunnions 34, 36 and tilts the cask 10 upwardly from its horizontal position to a vertical position, whereupon it is lifted off the railroad car.

It should be understood, of course, that the foregoing relates only to a preferred embodiment of the present invention and that numerous modifications or alterations may be made therein without departing from the spirit and scope of the invention as set forth in the appended claims:

We claim:

1. A cask for spent nuclear fuel assemblies, said cask comprising:

an elongate body member for containing said spent nuclear fuel assemblies, said body member having a top end and an outer surface;

a pair of trunnions disposed on said outer surface adjacent said top end, each of said trunnions comprising:

a surface for selective engagement by a lifting means;

a first element attachable to said body member to provide a first load path for supporting the weight of the body member when said trunnion surface is engaged by a lifting means;

a second element attachable to said body member to provide a second said load path; and means for attaching said first element and said second element to said body member, so that the first and second elements of each trunnion provide redundant first and second load paths for supporting the weight of said body member between the body member and the lifting means engaging the trunnion.

2. The cask of claim 1, wherein said first element has a boss thereon and said outer surface of said body member has a groove formed therein for receiving said boss to thereby form a first shear register.

3. The cask of claim 2, wherein said second element comprises an annular collar having an attachment end and said outer surface of said body member has a groove formed therein for receiving said attachment end of said annular collar to thereby form a second shear register.

4. The cask of claim 3, wherein said annular collar fits concentrically over said first element.

5. The cask of claim 4, wherein said annular collar has a groove formed therein for receiving lifting apparatus for selective engagement therewith, said groove having a flange for retaining said lifting apparatus in engagement with said groove.

6. The cask of claim 5, wherein each of said trunnions further comprises a third element having a flange for retaining said lifting apparatus in engagement with said groove in said annular collar, said flange of said annular collar partially defining said groove in said annular collar and said flange of said third element extending beyond said flange of said annular collar to thereby further define and deepen said groove in said annular collar.

7. The cask of claim 6, wherein said attaching means comprises a plurality of bolts.

8. A cask for spent nuclear fuel assemblies, said cask comprising:

an elongate body member for containing said spent nuclear fuel assemblies, said body member having a top end and an outer surface;

a pair of trunnions disposed on said outer surface adjacent said top end, each of said trunnions comprising:

engagement means for selective engagement by a lifting means;

first means operatively associated with said body member to provide a first load path for supporting the weight of the body member when said engagement means is engaged by a lifting means;

second means operatively associated with said body member to provide a second said load path between said body member and said engagement means; and means for attaching said first means and said second means to said body member, said first and second means of each trunnion providing redundant first and second load paths for supporting the weight of said body member between the body member and said engagement means, whereby if either of said first and second means fails, the remaining load path is sufficient to support the weight of the body member carried by that trunnion.

* * * * *